US005419261A

United States Patent [19]

Tarassoff et al.

[11] Patent Number: 5,419,261

[45] Date of Patent: May 30, 1995

[54] PASSENGER TRANSPORT INSTALLATION HAVING A PLURALITY OF TRACK SECTIONS

[75] Inventors: Serge Tarassoff; Georges Toyre, both of Seyssinet-Pariset, France

[73] Assignee: Pomagalski S.A., France

[21] Appl. No.: 183,934

[22] Filed: Jan. 21, 1994

[30] Foreign Application Priority Data

Feb. 8, 1993 [FR] France ..... 93 01630

[51] Int. Cl.[6] ..... B61B 9/00

[52] U.S. Cl. ..... 104/173.1; 104/178

[58] Field of Search ..... 104/173.1, 178, 179

[56] References Cited

U.S. PATENT DOCUMENTS

| | | | |
|---|---|---|---|
| 3,871,303 | 3/1975 | Woodling | 104/173.1 |
| 4,092,929 | 6/1978 | Laurent | 104/173.1 |
| 4,210,084 | 7/1980 | Peltie | 104/178 |
| 4,669,389 | 6/1987 | Tarrassoff | 104/178 X |

FOREIGN PATENT DOCUMENTS

| | | | |
|---|---|---|---|
| 218533 | 4/1987 | European Pat. Off. | 104/173.1 |
| 2337067 | 7/1977 | France . | |
| 2658772 | 8/1991 | France | 104/178 |
| 644714 | 4/1937 | Germany . | |
| 8102275 | 8/1981 | WIPO | 104/178 |

*Primary Examiner*—Robert J. Oberleitner
*Assistant Examiner*—S. Joseph Morano
*Attorney, Agent, or Firm*—Parkhurst, Wendel & Rossi

[57] ABSTRACT

A transport installation making use of passive vehicles hauled along a track by traction cables. The track is divided into successive track sections extending between successive stations and each equipped with a traction cable for moving the vehicle along this track section and for stopping it in the stations. The taking-over of the vehicle by the successive traction cable is operated in the station while the vehicle is stopped. The track section of greatest length is equipped with a greater number of independent traction cables to increase the transport capacity.

6 Claims, 2 Drawing Sheets

PASSENGER TRANSPORT INSTALLATION HAVING A PLURALITY OF TRACK SECTIONS

BACKGROUND OF THE INVENTION

1. Field of the invention

The invention relates to a passenger transport installation making use of independent passive vehicles hauled along a track by traction cables. The vehicles run on rails or runways, and the track is divided into a number of track sections, each track section extending between two stations and being equipped with at least a traction cable.

2. Description of the prior art

Installations of the kind indicated with vehicles running on special tracks at a high speed and stopping or running at low speed in the stations for loading and unloading of the passengers are known. The vehicles are hauled by a continuously moving high speed cable. Each vehicle has a clamping mechanism such as a detachable coupling grip for gripping the high speed cable and at the level of the stations the vehicle is uncoupled from the high speed cable and driven by friction wheels or separate traction cables in the deceleration and acceleration zones. The known installations are complicated and necessitate devices for the synchronization of the movements of the vehicle and of the drive means in the coupling and uncoupling zones.

SUMMARY OF THE INVENTION

The object of the present invention is to remedy these disadvantages and to provide an installation using passive vehicles and having a high transport capacity.

The passenger transport installation of the present invention comprises a traction cable which extends along the whole track section between two stations and the vehicle remains coupled to this traction cable during the whole travel on this track section. At the station the traction cable and the vehicle are stopped for loading and unloading of the passengers and the vehicle is uncoupled from the traction cable of this track section for coupling to the traction cable of the successive track section, to be driven by this traction cable along this successive track section. Each traction cable passes in a station on a drive wheel connected to a motor and the speed and the speed variations of the traction cable are determined by a control apparatus connected to the motor, which provides the acceleration, the high speed drive, the deceleration and the stopping of the vehicle. Only one vehicle is simultaneously coupled to one traction cable. The stations, particularly in urban areas, are not regularly spaced apart and according to the invention a track section of great length is equipped with two or more independent traction cables so that two or more vehicles run simultaneously on this track section. The transport capacity of the installation, which was restricted by the track section of great length, is thus increased and the other track sections are not modified.

In a simplified installation according to the invention the track section of great length comprises two traction cables, each driven by a motor, for hauling two independent vehicles simultaneously along this track section. The two traction cables are driven at the same high speed and the vehicles are spaced apart so that one vehicle is at the midway point of the track section when the other is stopping in the station. The transport capacity of this track section of great length is the same as that of a track section of half length, equipped with one traction cable. It is easily seen that a transport installation may have track sections equipped with one traction cable, other sections with two cables and other sections with three or more traction cables, in accordance to the length and/or to the authorized travel speed on this track section. Each traction cable passes in the stations over return wheels to form an endless cable loop and a drive motor rotates one of these return wheels to propel the cable loop. Each vehicle is coupled to a traction cable while running on a track section and its speed and position are derived from the traction cable movement. Such information is supplied to a control unit and the whole control of the installation is operated from this fixed control unit associated with the track. This control unit in particular controls the drive motors of the traction cables, equipping a same track section, so as to maintain an appropriate distance between successive vehicles. The control unit is advantageously of the kind described in U.S. Pat. No. 4,210,084 to which reference may be readily had and the disclosure of which is incorporated herein by reference. The control unit associates to each vehicle a theoretical protective zone, moving together with the vehicle and provides an output trip signal when the successive vehicle enters within this zone. The control unit comprises means for measuring the speed of the vehicle and for adapting the size of the protective zone to the speed. The size of this protective zone is of course adapted to the brake capacity of the successive vehicle.

The drive motors are connected to the control unit for regulating the vehicle drive system so that the vehicles are stopped substantially at the same time in the stations. On the track sections having a shorter length the speed of the vehicle may be lower so that the stopping time in the station is reduced.

The vehicles are cable driven through a clamping mechanism mounted on the underside of the vehicles for gripping the traction cable. Preferably the ends of the successive traction cables overlap and a vehicle stopped in the station may be selectively coupled to anyone of the traction cables of this station. The clamping mechanism includes two or more grips, each facing one of the traction cables, for instance spaced transversely of the track and the control unit controls the opening and the closing of these grips for gripping the appropriate traction cable and transferring the drive of the vehicle from one traction cable to another. In accordance of a not shown modification the vehicle includes only one grip which is transversely movable for gripping the appropriate cable. A clamping mechanism of the kind described in the U.S. Pat. No. 4,092,929 may be used.

DESCRIPTION OF PREFERRED EMBODIMENT

The invention will be further described, by way of example, with reference to the accompanying drawings, in which.

Figure 1:
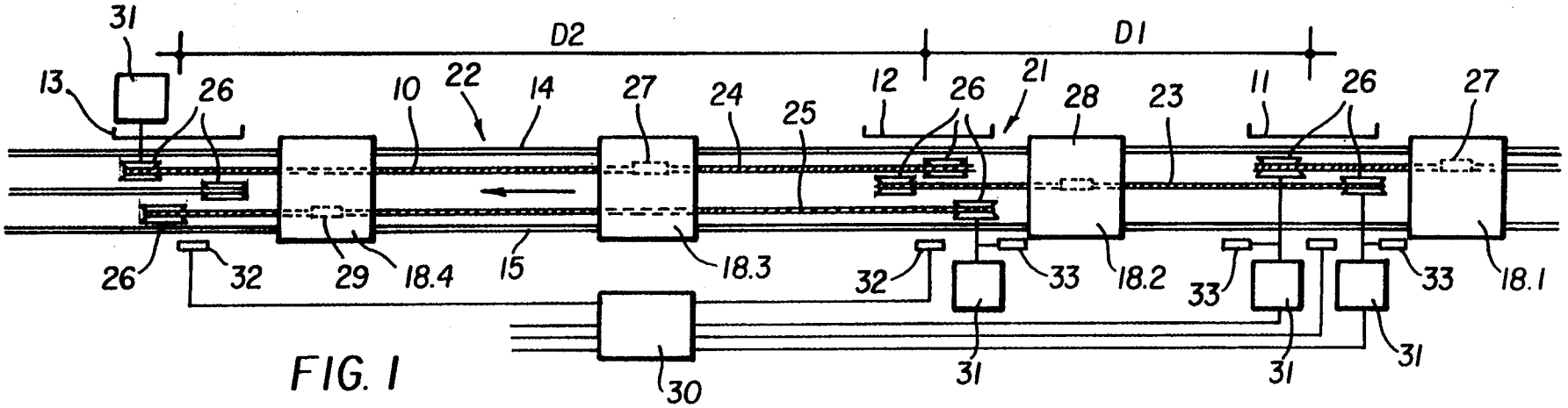
FIG. 1 is a schematic plan view of an installation in accordance with the invention having two track sections, showing the vehicles at the entrance of the stations.
Figure 3:
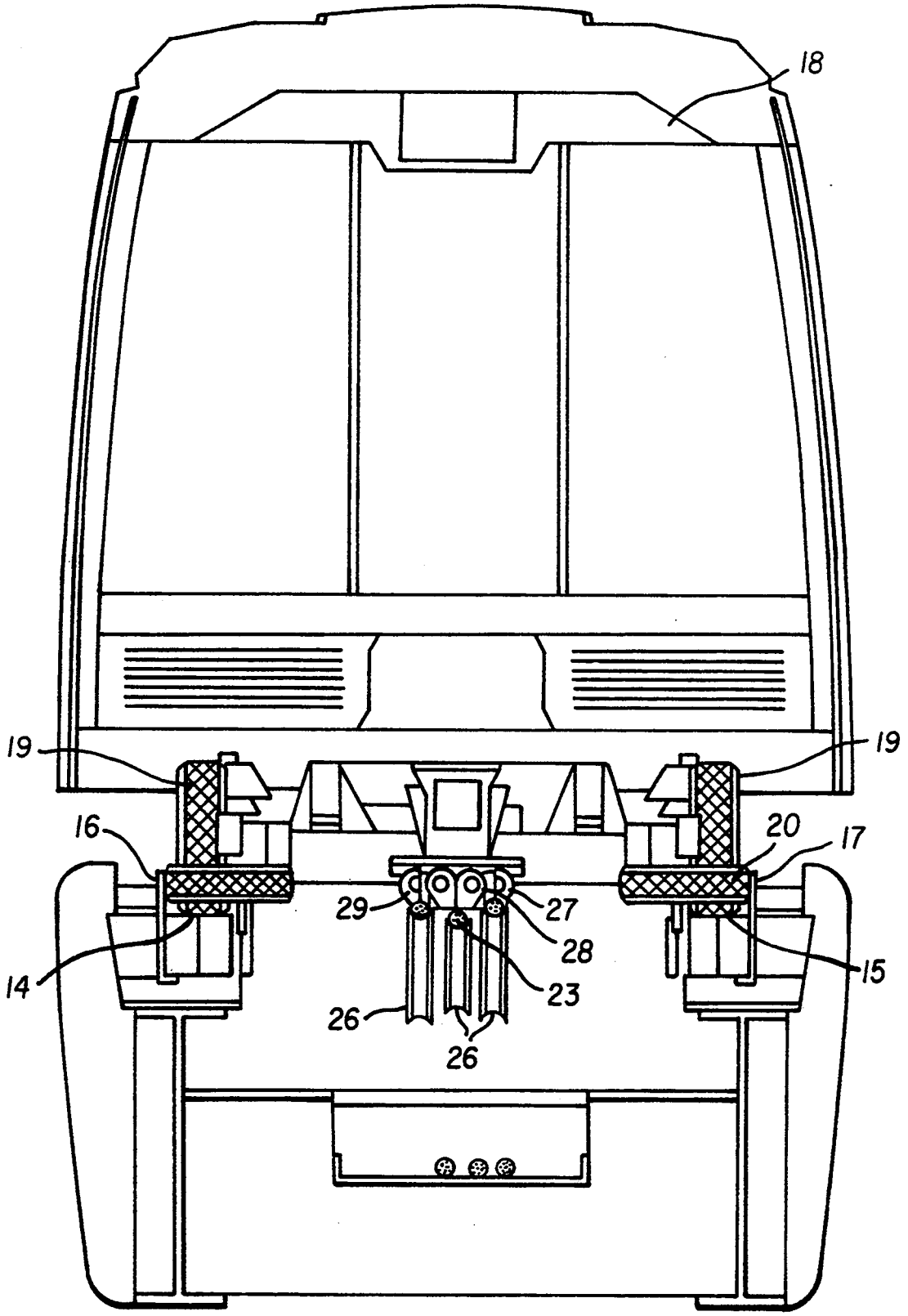
FIG. 3 is a sectional view of a vehicle of the installation according to FIG. 1, showing the vehicle in an intermediary station.

FIG. 1 shows a track portion 10, which extends between three successive stations 11,12,13 and comprises two runways 14,15 and two lateral guide rails 16,17. As shown in FIG. 3 vehicles 18 have supporting wheels 19, Which roll on the runways 14,15 and guide wheels 20 which roll on the guide rails 16,17 and these wheels 19,20 are preferably pneumatic tired. The distance D1 of the track section 21 between the first station 11 and the second station 12 is shorter than the distance D2 of the track section 22 between the second station 12 and the third station 13 and in the embodiment shown D2 is substantially twice D1. The vehicles 18 are towed on track 10 by traction cables 23,24,25 extending over the track sections 21,22 substantially at the level of the runways 14,15. Each traction cable 23,24,25 passes in the corresponding stations 11,12,13 over a return bull wheel 26 to form an endless cable loop,having a return portion located below the level of the runways 14,15. Each traction cable loop is driven by a motor 31 connected to one of the bull wheels 26. A short traction cable 23 extends between the first station 11 and the second station 12 to haul the vehicles 18 along the short track section 21. A first traction cable 24 and a second traction cable 25 extend parallel between the second 12 and the third 13 station to haul the vehicles 18 along the long track section 22. The traction cable ends are transversely spaced and overlap in the standstill zone of the vehicles in the stations.

Figure 2:
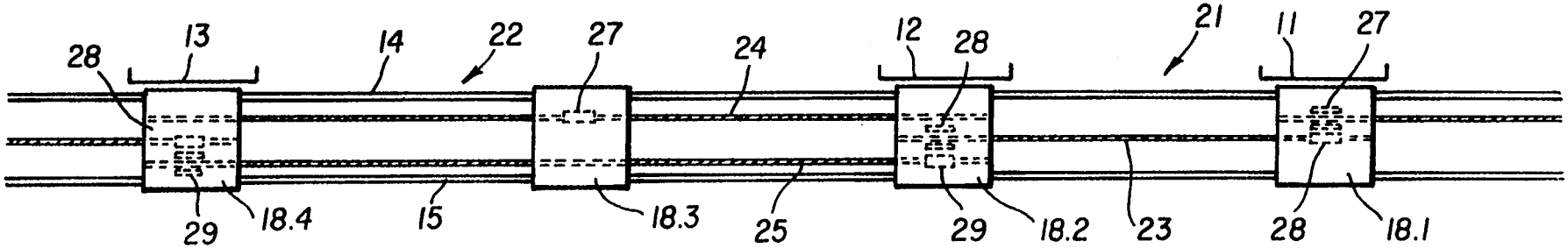
FIG. 2 is a view like FIG. 1, showing the position of the vehicles in the stations.

Referring to FIG. 3, vehicle 18 comprises three detachable grips 27,28,29 mounted substantially in the middle and transversely spaced on the underside of the vehicle, in alignment over the corresponding traction cables 23,24,25 for gripping these cables. The grips 27,28,29 may be spaced longitudinally along the vehicle 18. A grip actuating mechanism 33, such as a solenoid, is mounted on the vehicle 18 or is associated with the track, at the level of the station, to operate the coupling and uncoupling of the grips 27,28,29. As shown in FIGS. 2 and 3, in the station 12 the grip 28 is in alignment over the short traction cable 23, which has towed the vehicle 18 on the short track section 21 and which has been released by opening of the grip 28. Another grip 29 is in alignment over the second traction cable 25 of the long track section 22 and is closed for coupling the vehicle to this traction cable and for hauling the vehicle on this long track section 22. Such a grip system is for instance disclosed in the U.S. Pat. No. 4,092,929.

The installation according to the invention functions in the following manner:

In FIG. 1 the vehicles 18 run on track 10 in the direction of the arrow and only the closed grips are shown. Vehicle 18.1 is shown entering the first station 11 and at the same time vehicle 18.2 is entering the second station 12 and vehicle 18.4 the third station 13. Vehicle 18.3 is at the midway between the second station 12 and the third station 13. Vehicle 18.2 is coupled to and hauled by the short traction cable 23 of the short track section 21. The vehicle 18.3 running on the long track section 22, is coupled to the first traction cable 24 of this track section 22 and the other vehicle 18.4 is coupled to the second traction cable 25. The short traction cable 23 of the short track section 21 and the second traction cable 25 of the long track section 22 are then braked for stopping the vehicles 18.2 and 18.4 in the corresponding second station 12 and third station 13 and at the same time vehicle 18.1 is stopping at the first station 11.( FIG. 2) The passengers of the vehicles 18.1, 18.2 and 18.4 can step out or enter and the transferring of the drive of these vehicles from one traction cable to another is actuated. Vehicle 18.1 is uncoupled from its traction cable and coupled to the short traction cable 23 of the short track section 21. Vehicle 18.2 is uncoupled from the short traction cable 23 and coupled to the second traction cable 25 of the long track section 22. Vehicle 18.4 is uncoupled from this second traction cable 25 and coupled to the next cable. FIG. 2 represents the positioning of the various grips 27,28,29 providing these couplings and uncouplings. While the vehicles 18.1, 18.2, and 18.4 are stopped, the vehicle 18.3, coupled to the first traction cable 24 and substantially at the midway of the long track section 22, runs at high speed. The stopped traction cables 23,25 are then accelerated for hauling the vehicles to the next stations. It may be seen that two vehicles 18.3, 18.4 run at the same time independently on the long track section 22, while one vehicle 18.2 Puns on the short track section 21 and that the successive vehicles on the long track section 22 are alternatively coupled to the first and to the second traction cables 24 and 25 of this track section. The long track section 22 has thus the same transport capacity as the short track section 21, when the speeds of the vehicles are the same. The number of traction cables equipping a track section may be increased as desired, particularly when the length is greater or when the running speed of the vehicles on this section is smaller. It will be advantageous to provide the same vehicle stopping time in each station and thus to control the vehicle speeds on the different track sections of the installation so that the running time on each section is substantially the same.

The installation according to the invention is preferably automated by centralizing all the controls. A control unit 30 is connected to the stations 11,12,13 and more particularly to the traction cables 23,24,25 or motors 31. The vehicles 18 are permanently coupled to a traction cable 23,24,25 or stopped in a station and their position and/or speed can be measured by detectors 33 associated with the traction cables 23,24,25, their motors 31, the return wheels 26 or the track 10. The output signals of the detectors 33 are transmitted to the contol unit 30 for controlling the acceleration, deceleration and stopping of the traction cables 23,24,25 and of the associated vehicles 18. Control unit 30 controls the grip actuating mechanisms 33 for coupling and uncoupling the vehicles 18 from the traction cables in the stations. Control unit 30 further provides synchronization of the vehicle movements and emits an alarm or tripping signal when the distance between two successive vehicles is too short. This safety device is of the kind disclosed in the U.S. Pat. No. 4,210,084, which associates to each vehicle a protective zone, moving with it and which emit the alarm signal when a successive vehicle is entering in this protective zone. Control unit 30 adapts the size of this protective zone to the vehicle braking capacity and/or to the speeds of the vehicles.

The installation according to the invention is particularly adapted to urban transport and its simplicity results on the one hand from the whole control of the installation by a central control unit 30 associated with the track and on the other hand from the taking-over of the vehicles by the traction cables while the vehicles are stopped in the stations. The system may easily be automated by centralizing all the controls at one fixed point. The transport capacity of the installation may be easily increased by equipping the track section having the smallest transport capacity with an additional traction cable. The vehicle may be of any size and constituted by a train of vehicles and the track may be a railway track or a cableway track.

What is claimed is:

1. A transport installation, comprising:

a plurality of independent vehicles;

a track whereon the vehicles run;

a plurality of stations successively spaced apart along the track thereby defining a plurality of track sections, each track section extending between two successive stations, said plurality of said track sections including a first track section extending between first and second stations, and a second track section extending between said second station and a third station, said second track section having a length greater than a length of the first track section;

traction cables for hauling the vehicles along the track, each track section having at least one of said traction cables for driving the vehicles along said each track section, wherein said second track section has a greater number of traction cables with respect to a number of traction cables of said first track section, thereby to increase a transport capacity of said second track section with respect to a transport capacity of said first track section;

driving means for independently driving and stopping each traction cable; and coupling means for uncoupling a vehicle from a traction cable of one of said first and second track sections, while said vehicle is stopped at said second station, and for subsequently coupling said vehicle to a traction cable of the other of said first and second track sections, said coupling means comprising at least one grip secured to each vehicle, wherein only a single vehicle is simultaneously coupled to each traction cable.

2. The transport installation of claim 1, wherein each traction cable forms a loop which extends around return bull wheels located at each station.

3. The transport installation of claim 1, wherein said second track section comprises control means for providing signals representative of the position of the vehicles running along said second track section, and a control unit for comparing said signals and providing an output control signal representative of distances between the vehicles running along the second track section.

4. The transport installation of claim 3, wherein the vehicles running along said second track section include a first vehicle and a second vehicle, and the control unit provides a theoretical protective zone for each vehicle traveling along the second track section, and provides an output trip signal when the second vehicle enters the protective zone of the first vehicle.

5. The transport installation of claim 4, wherein the control unit is adapted to measure the speed of each of the vehicles traveling along the second track section, and calculates the protective zone based upon the measured speeds.

6. The transport installation of claim 1, wherein the traction cables of the second track section overlap the traction cables of the first track section.

* * * * *